US008686661B2

(12) United States Patent
Li

(10) Patent No.: US 8,686,661 B2
(45) Date of Patent: Apr. 1, 2014

(54) LED DIMMING METHOD AND LED DIMMING SYSTEM

(75) Inventor: Fei Li, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 104 days.

(21) Appl. No.: 13/375,477

(22) PCT Filed: Aug. 18, 2011

(86) PCT No.: PCT/CN2011/078598
§ 371 (c)(1),
(2), (4) Date: Nov. 30, 2011

(87) PCT Pub. No.: WO2013/013430
PCT Pub. Date: Jan. 31, 2013

(65) Prior Publication Data

US 2013/0026951 A1 Jan. 31, 2013

(30) Foreign Application Priority Data

Jul. 26, 2011 (CN) ..... 2011 1 0210436

(51) Int. Cl.
*H05B 41/36* (2006.01)
*H05B 37/02* (2006.01)

(52) U.S. Cl.
USPC ..... 315/291; 315/297; 315/294; 315/210; 315/307

(58) Field of Classification Search
USPC ..... 315/291, 297, 294, 210, 247, 186, 308, 315/136, 193, 129, 224
See application file for complete search history.

(56) References Cited

U.S. PATENT DOCUMENTS

| | | | | |
|---|---|---|---|---|
| 7,888,881 | B2 * | 2/2011 | Shteynberg et al. | 315/291 |
| 7,936,132 | B2 * | 5/2011 | Quek et al. | 315/291 |
| 2011/0279040 | A1 * | 11/2011 | Briggs et al. | 315/136 |
| 2011/0279048 | A1 * | 11/2011 | Briggs | 315/210 |

FOREIGN PATENT DOCUMENTS

| | | | |
|---|---|---|---|
| CN | 1829398 | A | 9/2006 |
| CN | 201462730 | U | 5/2010 |
| CN | 101902861 | A | 12/2010 |
| CN | 201673655 | U | 12/2010 |
| CN | 201780763 | U | 3/2011 |
| CN | 102077767 | A | 6/2011 |
| WO | WO2010061531 | A1 | 6/2010 |

OTHER PUBLICATIONS

Chen Yajuan, The International Searching Authority written comments, May 2012, CN.
Ding Peng, The first office action, Dec. 2012, CN.
Ding Peng, The second office action, Aug. 2013, CN.

* cited by examiner

*Primary Examiner* — Vibol Tan
(74) *Attorney, Agent, or Firm* — IPro, Inc.; Na Xu

(57) ABSTRACT

The present invention discloses a LED dimming method and a LED dimming system, wherein the LED dimming method comprises the following steps: A: calculating the equivalent current flowing through the LED in accordance with the duty cycle message of the input PWM signal; and B: regulating the current flowing through the LED to the equivalent current. Because the equivalent current flowing through the LED is calculated by the duty cycle message D of the input PWM signal while the duty cycle is not actually regulated, the present invention realizes the aim that the dimming uniformity is improved by linearly regulating the current flowing through the LED. Meanwhile, transformer noise will not be generated because current flows through the transformer in the overall dimming cycle.

6 Claims, 3 Drawing Sheets

LED DIMMING METHOD AND LED DIMMING SYSTEM

TECHNICAL FIELD

The present invention relates to the field of liquid crystal displays (LCDs), particularly to a dimming method of a light-emitting diode (LED) and a LED dimming system for LCDs.

BACKGROUND

Because the quality of the LED backlight affects the stability, luminosity and color of images, a LED backlight is one of the important components of the LCDs. In the current design of backlights, LEDs replace the Cold Cathode Fluorescent Lamp (CCFL) technology rapidly because LEDs have the advantages of less requirement of voltage, ease of use, stronger dimming capacity, no mercury and higher efficiency. With the continuous improvement of the LEDs in the aspects of luminosity and cost, the LEDs are gradually applied to large LCDs.

Presently the dimming method for a LED backlight is PWM (Pulse Width Modulation) dimming. The value of a LED current is at its maximum in the PWM positive duty cycle, and the average value of a LED current is regulated by change of the positive duty cycle, so that the LED backlight is dimmed. An example is as below.

Suppose: LED $V_f$=3.3V, and $I_f$=60 mA, and dimming frequency f=100 Hz, and dimming duty cycle D=50%. If the light-emitting luminance of the LED is measured by the average power, the power corresponding to the maximum luminance is $w=V_f*I_f*1/f=3.3\times0.06\times1/100=1.98$ mW. When the dimming duty cycle D=50%, the power corresponding to the light-emitting luminance is $w=3.3\times0.06\times1/100\times1/2=0.99$ mW. It is therefore obvious that the duty cycle D and the light-emitting power are correlated.

The PWM dimming frequency is generally between 100~500 Hz, within the hearing frequency range of a person. Because mechanical vibrations can be generated by the coils of an inductor when a low frequency switching signal acts on a wound inductor, the frequency of the mechanical vibration just falls within the above frequency; and the noise emitted by the inductor can be heard by the ears of a person. Meanwhile, because the fixed delay in the PWM dimming consumes a part of the fixed cycle, the dimming uniformity is reduced.

SUMMARY

The aim of the present invention is to provide a drive method of a LED backlight with high dimming uniformity and a device thereof.

The purpose of a LED dimming method of the present invention is achieved by the following technical schemes.

A LED dimming method comprises the following steps.

A: Calculating the equivalent current flowing through the LED according to the duty cycle message of the input PWM signal;

B: Regulating the current flowing through the LED to be equal to the equivalent current in the step A.

Preferably, in the step B, the process for regulating the current flowing through the LED is achieved by regulating the output voltage by using the equivalent current calculated in the step A as a comparison benchmark, and by comparing the current flowing through the LED with the comparison benchmark to enable the current flowing through the LED to be equal to the comparison benchmark. The method is simple by comparing the feedback current with the calculated equivalent current.

Preferably, in the step B, the process for regulating the current flowing through the LED is achieved by calculating the voltage corresponding to the equivalent current, and regulating the LED output voltage according to the corresponding voltage. The LED current is linearly changed by regulating the linear change of the output voltage, and the regulation method is very simple.

The purpose of a LED dimming system of the present invention is achieved by the following technical schemes.

A LED dimming system comprises: a LED, and an input module of a duty cycle message, wherein the input module of a duty cycle message is used for receiving the duty cycle message of the input PWM signal;

a calculation module of an equivalent current for duty cycle message which is connected with the input module of a duty cycle message, wherein the calculation module of an equivalent current for duty cycle message is used for calculating the equivalent current flowing through the LED according to the duty cycle message obtained by the input module of a duty cycle message;

and a current regulation module which is in controllable connection with the LED and the calculation module of an equivalent current for duty cycle message, wherein the current regulation module is used for regulating the current flowing through the LED to the equivalent current calculated by the calculation module of an equivalent current for duty cycle message.

The current regulation module comprises:

a voltage regulation module for regulating the LED output voltage, and a comparator; wherein the comparator is connected with the LED, the calculation module of an equivalent current for duty cycle message, and the voltage regulation module;

wherein the comparator is used for comparing the equivalent current calculated by the calculation module of the equivalent current as a comparison benchmark with the current flowing through the LED;

and the voltage regulation module is used for regulating the LED output voltage in accordance with the comparison result of the comparator, to enable the current flowing through the LED to be equal to the equivalent current calculated by the calculation module of an equivalent current for duty cycle message. The regulation of the current by the comparator is simple and accurate.

Preferably, the current regulation module comprises:

a calculation module of an equivalent voltage which is in controllable connection with the calculation module of an equivalent current for duty cycle message, wherein the calculation module of an equivalent voltage is used for calculating the voltage corresponding to the equivalent current calculated by the calculation module of an equivalent current for duty cycle message;

and a voltage regulation module which is in controllable connection with the LED and the calculation module of an equivalent current for duty cycle message respectively, wherein the voltage regulation module is used for regulating the LED output voltage in accordance with the corresponding voltage obtained by the voltage regulation module.

Because the equivalent current flowing through the LED is equivalently calculated by the duty cycle message D of the input PWM signal while the duty cycle is not actually regulated, the present invention realizes the aim that the current flowing through the LED is linearly regulated, so that the dimming uniformity is improved. Meanwhile, transformer noise will not be generated because the current flows through the transformer in the overall dimming cycle.

DETAILED DESCRIPTION

The invention will further be described in detail in accordance with the figures and the preferred embodiments.

The LED dimming method of one embodiment of the present invention comprises the following steps.

A: Calculating the equivalent current flowing through the LED according to the duty cycle message of the input PWM signal; wherein, the duty cycle of the input PWM signal multiplied by the maximum current is equal to the equivalent current;

B: Regulating the current flowing through the LED to be equal to the equivalent current in the step A.

In accordance with the light-emitting power of the LED, $w=V_f^*\times I_f^*1/f^*D$; wherein, $V_f$ is the output voltage, and $I_f$ is the current flowing through the LED, and D is the duty cycle of the PWM signal. Because the intrinsic characteristic of the LED, the voltage and the current of the LED and the luminance is not of linear relationship; 0-100% linear variation can not be obtained by directly regulating the current flowing through the LED or the voltage, but 0-100% linear variation of the luminance can be achieved by regulating the duty cycle. Therefore, by adopting the regulation mode of the duty cycle D of the input PWM signal without actually regulating the duty cycle D, the equivalent current flowing through the LED is calculated in accordance with the duty cycle message; the current flowing through the LED is regulated in accordance with the result, which leads to a linear variation in light luminance so that the dimming uniformity can be improved. Because the current flows through the transformer in the overall dimming cycle, D is 100%, inductor coils will not generate mechanical vibrations, so that transformer noise will not be generated.

Figure 1:
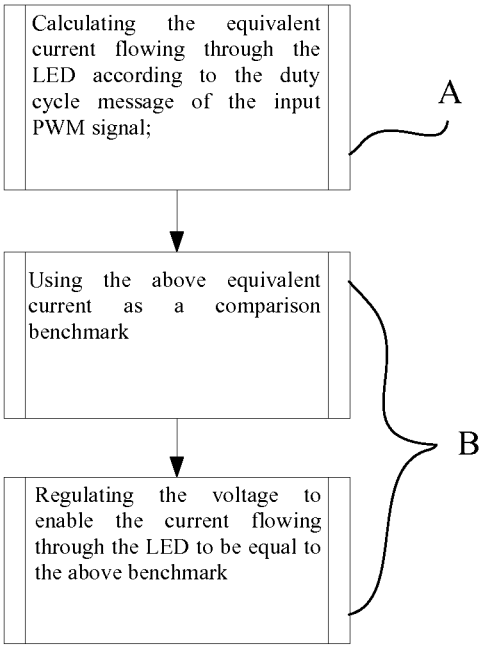
FIG. 1 is the flow diagram of one LED dimming method of one embodiment of the present invention.
Figure 2:
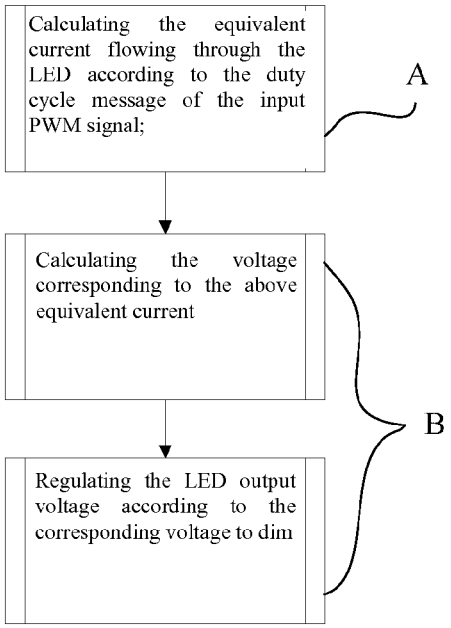
FIG. 2 is the flow diagram of another LED dimming method of one embodiment of the present invention.

When $V_f$ is changed, $I_f$ is changed. Therefore, in the step B, the process for regulating the current flowing through the LED is achieved by regulating the output voltage by using the equivalent current calculated in the step A as a comparison benchmark, and comparing the current flowing through the LED with the comparison benchmark to enable the current flowing through the LED to be equal to the comparison benchmark. Thus, the current flowing through the LED is regulated, as shown in FIG. 1. Alternatively, the process for regulating the current flowing through the LED is achieved by calculating the voltage corresponding to the equivalent current and regulating the LED output voltage according to the corresponding voltage. Thus, the current flowing through the LED is regulated, as shown in FIG. 2.

The LED dimming system for achieving the above dimming method comprises a LED, an input module of a duty cycle message, a calculation module of an equivalent current for the duty cycle message which is connected with the input module of a duty cycle message, and a current regulation module which is in controllable connection with the LED and the calculation module of an equivalent current for duty cycle message; wherein the input module of a duty cycle message is used for receiving the duty cycle message of the input PWM signal; the calculation module of an equivalent current for duty cycle message is used for calculating the equivalent current flowing through the LED according to the duty cycle message obtained by the input module of a duty cycle message; and the current regulation module is used for regulating the current flowing through the LED to be equal to the equivalent current calculated by the calculation module of an equivalent current for duty cycle message.

Figure 3:
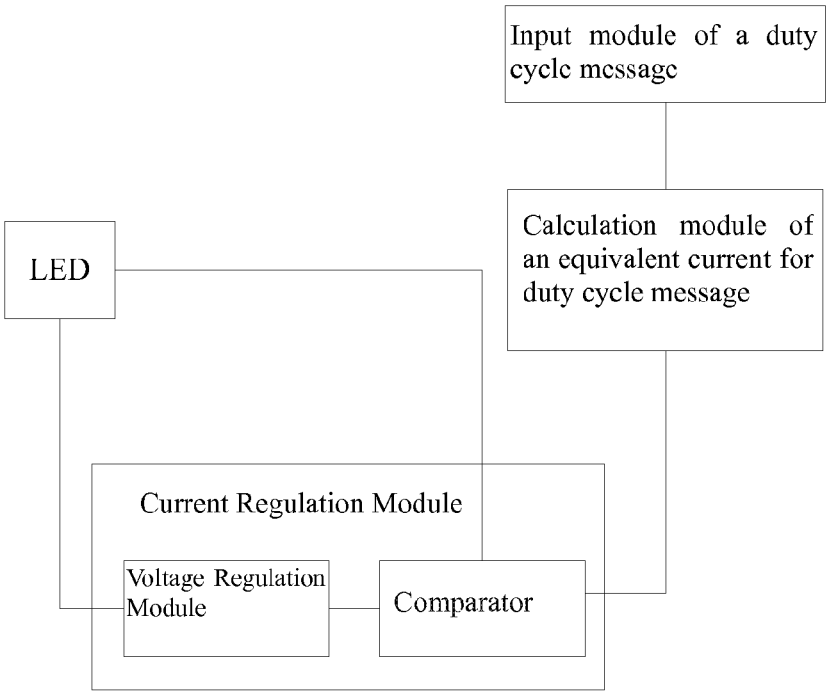
FIG. 3 is the schematic diagram of one module of the LED dimming system of one embodiment of the present invention.

As shown in FIG. 3, the current regulation module comprises a voltage regulation module for regulating the LED output voltage and a comparator; the comparator is connected with the LED, the calculation module of an equivalent current for duty cycle message and the voltage regulation module; wherein the comparator is used for comparing the equivalent current calculated by the calculation module of an equivalent current as a comparison benchmark with the current flowing through the LED; and the voltage regulation module is used for regulating the LED output voltage in accordance with the comparison result of the comparator, to enable the current flowing through the LED to be equal to the equivalent current calculated by the calculation module of an equivalent current for duty cycle message so that dimming is achieved.

Figure 4:
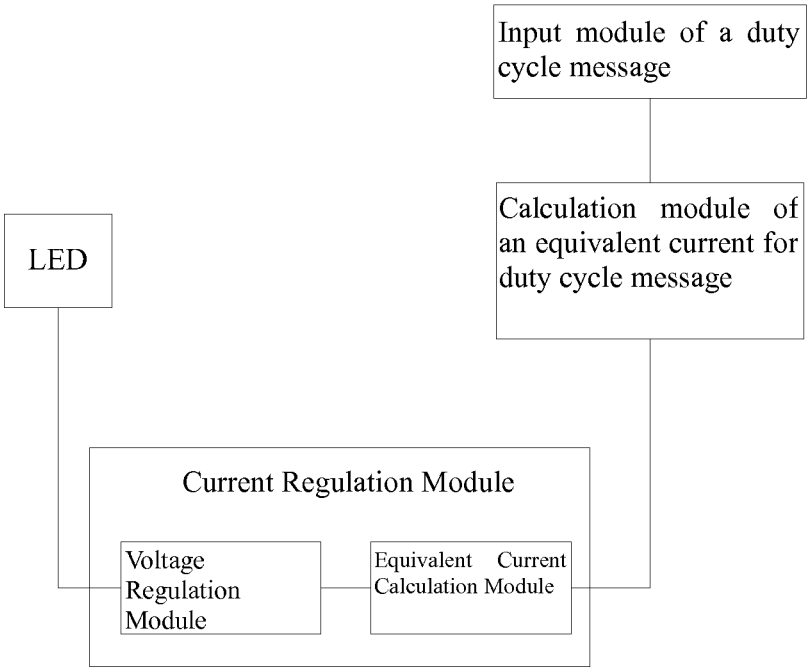
FIG. 4 is the schematic diagram of another module of the LED dimming system of one embodiment of the present invention.

As shown in FIG. 4, the current regulation module comprises a calculation module of an equivalent voltage which is in controllable connection with the calculation module of an equivalent current for duty cycle message, and a voltage regulation module which is in controllable connection with the LED and the calculation module of an equivalent voltage respectively; wherein the calculation module of an equivalent voltage is used for calculating the voltage corresponding to the equivalent current calculated by the calculation module of an equivalent current for duty cycle message; and the voltage regulation module is used for regulating the LED output voltage in accordance with the corresponding voltage obtained by the voltage regulation module. The output voltage is linearly changed by regulating the voltage regulation module arranged in the LED dimming system, so that the current is linearly changed.

Take the current regulation mode shown in FIG. 3 as an example. Suppose during a normal operating (positive duty cycle D=100%), the current of a string of LEDs is 60 mA, and the operating voltage is 30V; suppose during dimming, in the condition of the positive duty cycle D=50%, the dimming frequency is 100 Hz, and then the light-emitting power is $W=0.06\times30\times0.5\times1/100=9$ mW. When the duty cycle D is not actually regulated but its equivalency is attempted: the input module of a duty cycle message obtains D=50%; 45 mA equivalent current is calculated and determined by the calculation module of an equivalent current for duty cycle message through a multiplier and is used as the comparator benchmark; the output voltage is directly regulated by the voltage regulation module so that the current flowing through the LED is equal to the comparator benchmark, namely the equivalent current is 45 mA; at the this time, the output voltage is 20V, and the light-emitting power is $W=0.045\times20\times1/100=9$ mW. Dimming is achieved in the condition equal to D=50%. But since the current keeps its linear variation in the overall dimming cycle at this moment, the dimming uniformity is improved. Meanwhile, transformer noise will not be generated because the current flows through the transformer in the overall dimming cycle.

The present invention is described in detail in accordance with the above contents with the specific preferred embodiments. However, this invention is not limited to the specific embodiments. For the ordinary technical personnel of the technical field of the present invention, on the premise of keeping the conception of the present invention, the technical personnel can also make simple deductions or replacements, and all of which should be considered to belong to the protection scope of the present invention.

I claim:

1. An LED dimming method comprising the steps of:

A: Calculating an equivalent current flowing through the LED according to a duty cycle message of an input PWM signal; and B: Regulating a current flowing through the LED to be equal to the equivalent current in the step A without changing an actual duty cycle of the current flowing through the LED.

2. The LED dimming method of claim 1, wherein in said step B, the process for regulating the current flowing through the LED is achieved by regulating an output voltage by using the equivalent current calculated in the step A as a comparison benchmark, and by comparing the current flowing through the LED with the comparison benchmark to enable the current flowing through the LED to be equal to the comparison benchmark.

3. The LED dimming method of claim 1, wherein in said step B, the process for regulating the current flowing through the LED is achieved by calculating a voltage corresponding to the equivalent current, and regulating the LED output voltage according to the corresponding voltage.

4. An LED dimming system comprising:

an LED;

an input module of a duty cycle message, a calculation module of an equivalent current for a duty cycle message which is connected with the input module of a duty cycle message, and a current regulation module which is in controllable connection with the LED and the calculation module of an equivalent current for duty cycle message;

said input module of a duty cycle message is used for receiving the duty cycle message of an input PWM signal;

said calculation module of an equivalent current for duty cycle message is used for calculating the equivalent current flowing through the LED according to the duty cycle message obtained by the input module of a duty cycle message; and said current regulation module is used for regulating the current flowing through the LED to be equal to the equivalent current calculated by the calculation module of an equivalent current for duty cycle message without changing an actual duty cycle of the current flowing through the LED.

5. The LED dimming system of claim 4, wherein said current regulation module comprises a voltage regulation module for regulating the LED output voltage, and a comparator;

said comparator is connected with the LED, the calculation module of an equivalent current for duty cycle message and the voltage regulation module;

said comparator is used for comparing the equivalent current calculated by the calculation module of an equivalent current as a comparison benchmark with the current flowing through the LED; and said voltage regulation module is used for regulating the LED output voltage in accordance with the comparison result of the comparator, to enable the current flowing through the LED to be equal to the equivalent current calculated by the calculation module of an equivalent current for duty cycle message.

6. The LED dimming system of claim 4, wherein said current regulation module comprises a calculation module of an equivalent voltage which is in controllable connection with the calculation module of an equivalent current for duty cycle message, and a voltage regulation module which is in controllable connection with the LED and the calculation module of an equivalent current for duty cycle message respectively;

said calculation module of an equivalent voltage is used for calculating the voltage corresponding to the equivalent current calculated by the calculation module of an equivalent current for duty cycle message;

and said voltage regulation module is used for regulating the LED output voltage in accordance with the corresponding voltage obtained by the voltage regulation module.

* * * * *